US007926744B2

(12) United States Patent
Thomson et al.

(10) Patent No.: US 7,926,744 B2
(45) Date of Patent: Apr. 19, 2011

(54) RADIALLY OUTWARD FLOWING AIR-BLAST FUEL INJECTOR FOR GAS TURBINE ENGINE

(75) Inventors: Neal A. Thomson, West Des Moines, IA (US); Philip E. O. Buelow, West Des Moines, IA (US); David H. Bretz, West Des Moines, IA (US)

(73) Assignee: Delavan Inc, West Des Moines, IA (US)

( * ) Notice: Subject to any disclaimer, the term of this patent is extended or adjusted under 35 U.S.C. 154(b) by 365 days.

(21) Appl. No.: 12/070,828

(22) Filed: Feb. 21, 2008

(65) Prior Publication Data

US 2009/0212139 A1 Aug. 27, 2009

(51) Int. Cl.
*B05B 7/10* (2006.01)
*B05B 7/04* (2006.01)
*F02C 1/00* (2006.01)

(52) U.S. Cl. ..... 239/405; 239/434.5; 60/742; 60/743; 60/748

(58) Field of Classification Search ..... 239/290, 239/424, 294, 425, 296, 300, 399, 400, 403–406, 239/418, 419, 423, 434.5, 533.2, 584; 60/740, 60/472, 743, 748
See application file for complete search history.

(56) References Cited

U.S. PATENT DOCUMENTS

| | | | | |
|---|---|---|---|---|
| 3,899,884 | A | 8/1975 | Ekstedt | |
| 3,980,233 | A | 9/1976 | Simmons et al. | |
| 5,224,333 | A | 7/1993 | Bretz et al. | |
| 5,761,907 | A | 6/1998 | Pelletier et al. | |
| 6,272,840 | B1 | 8/2001 | Crocker et al. | |
| 6,354,072 | B1 | 3/2002 | Hura | |
| 6,363,726 | B1 | 4/2002 | Durbin et al. | |
| 6,367,262 | B1 | 4/2002 | Mongia et al. | |
| 6,381,964 | B1 | 5/2002 | Pritchard, Jr. et al. | |
| 6,389,815 | B1 | 5/2002 | Hura et al. | |
| 6,418,726 | B1 | 7/2002 | Foust et al. | |
| 6,484,489 | B1 | 11/2002 | Foust et al. | |
| 6,688,534 | B2 | 2/2004 | Bretz | |
| 7,540,154 | B2 | 6/2009 | Tanimura et al. | |
| 2002/0011064 | A1 | 1/2002 | Crocker et al. | |
| 2002/0088234 | A1 | 7/2002 | Brundish et al. | |
| 2004/0079086 | A1 | 4/2004 | Smith et al. | |
| 2005/0039456 | A1 | 2/2005 | Hayashi | |
| 2006/0021350 | A1 | 2/2006 | Sanders | |
| 2006/0248898 | A1 * | 11/2006 | Buelow et al. | 60/776 |

FOREIGN PATENT DOCUMENTS

| | | |
|---|---|---|
| EP | 1 413 830 A2 | 4/2004 |
| EP | 1 413 830 A3 | 7/2006 |

* cited by examiner

*Primary Examiner* — Darren W Gorman

(74) *Attorney, Agent, or Firm* — Scott D. Wofsy; Edwards Angell Palmer & Dodge LLP

(57) ABSTRACT

An air-blast fuel injector is disclosed which includes an outer air circuit having an exit portion, an inner air circuit having an outlet configured to direct air toward the exit portion of the outer air circuit, and a fuel circuit radially outboard of the inner air circuit and having an exit communicating with the outer air circuit upstream from the exit portion of the outer air circuit.

8 Claims, 9 Drawing Sheets

RADIALLY OUTWARD FLOWING AIR-BLAST FUEL INJECTOR FOR GAS TURBINE ENGINE

BACKGROUND OF THE INVENTION

1. Field of the Invention

The subject invention is directed to a fuel injector for a gas turbine engine, and more particularly, to a radially outwardly flowing air-blast fuel injector for a gas turbine engine.

2. Description of Related Art

Air-blast fuel injectors for issuing atomized fuel into the combustor of a gas turbine engines are known in the art. Also known in the art are staged fuel injectors designed to improve engine efficiency. Here, the combustion process is divided into two or more stages or zones, which are generally separated from each other, either radially or axially, but still permitted some measure of interaction. For example, the combustion process may be divided into a pilot combustion stage and a main combustion stage. Each stage is designed to provide a certain range of operability, while maintaining control over the levels of pollutant formation. For low power operation, only the pilot stage is active. For higher power conditions, both the pilot and main stages may be active. In this way, proper fuel-to-air ratios can be controlled for efficient combustion, reduced emissions, and good stability.

One example of a staged fuel injector is disclosed in U.S. Patent Application Publication No. 2006/0248898 to Buelow et al. The injector includes a radially outer main pre-filming fuel delivery system, and an on-axis pilot pre-filming fuel delivery system. Another example of a staged air-blast fuel injector is disclosed in U.S. Pat. No. 6,272,840 Crocker et al. Here the main fuel delivery system is a pre-filming air-blast type atomizer and the pilot fuel delivery system is either a simplex air-blast type atomizer or a pre-filming air-blast type atomizer.

In prior art staged pre-filming air-blast type atomizers such as those described above, fuel in the main and pilot delivery systems exits from a fuel circuit, and flows radially inward to form a fuel sheet on a filming surface. High-speed air is directed over the filming surface to effect atomization of the fuel and mixing of the fuel and air. High-speed air is also directed across the exit lip of the filming surface to enhance atomization and control the resulting spray cone angle of the atomized fuel.

In addition to staged combustion, providing a thoroughly blended fuel-air mixture prior to combustion can significantly reduce engine emissions. While the prior art staged pre-filming air-blast type atomizers described above can provide a well blended fuel-air mixture, it is desirable to provide an air-blast atomizer designed to even more thoroughly mix fuel and air prior to combustion. This would lead to still further reductions of engine emissions and pollutants.

SUMMARY OF THE INVENTION

The subject invention is directed to a radially outwardly flowing air-blast fuel injector for gas turbine engines. More particularly, the subject invention is directed to an air-blast type fuel atomizer wherein fuel issuing from the fuel swirler does not flow radially inward, as in prior art air-blast type atomizers, but rather the fuel issuing from the fuel swirler flows radially outward and exits the fuel swirler at a diameter that is greater than the diameter of the fuel swirl slots. As a result of this unique configuration, the degree or rate of fuel/air mixing in the atomizer of the subject invention is greatly enhanced, thereby reducing the levels of pollutant emissions (e.g., oxides of nitrogen).

As described in more detail below, it is envisioned that fuel exiting the fuel swirler of the air-blast atomizer can form a sheet or film along the radially outwardly lying filming surface, or a fuel sheet can flow radially outwardly from the fuel swirler, breaking free of the filming surface so as to penetrate the high-speed atomizing air flowing over the filming surface. These two modes of operation would be functions of the relative momentum ratios between the swirling fuel and the cross-flowing air.

Another feature of the air-blast fuel injector of the subject invention is the ability to form different types of fuel flow formations or morphology. Moreover, by appropriately choosing the angle of the fuel swirl slots relative to the axial direction and the flow-path exit area of the fuel swirler, the flowing fuel, which exits the fuel passage, can be configured to form a continuous sheet or a series of discrete jets. The ability to produce different types of fuel sprays permits greater control over fuel placement (e.g., deeper penetration of the fuel into the outer-air stream).

Another feature of the subject invention is that when the fuel flow is shut off, the radially outwardly directed fuel passage downstream of the fuel swirler will self-drain. Thus, it will not retain any trapped fuel, which can form carbon (e.g., coking) under the high operating temperatures of the gas turbine.

In one embodiment of the subject invention, the air-blast fuel injector includes an outer air circuit having an exit portion, which may be defined by a diverging exit portion, an inner air circuit having an outlet configured to direct air toward the exit portion of the outer air circuit, and a fuel circuit outboard of the inner air circuit and having an exit communicating with the outer air circuit upstream from the exit portion of the outer air circuit.

In another embodiment of the subject invention, the air-blast fuel injector includes an outer air circuit having an exit portion, which may be defined by a diverging exit portion, an inner air circuit having a radial outlet for directing air toward the exit portion of the outer air circuit, and a fuel circuit outboard of the inner air circuit and having an exit communicating with the outer air circuit upstream from the radial outlet of the inner air circuit.

In yet another embodiment of the subject invention, the air-blast fuel injector includes an outer air circuit having an exit portion, which may be defined by a diverging exit portion, an inner air circuit having a radial outlet for directing air toward the exit portion of the outer air circuit, and a fuel circuit outboard of the inner air circuit and having an exit communicating with the outer air circuit embedded in the radial outlet of the inner air circuit.

In still another embodiment of the subject invention, the air-blast fuel injector includes an outer air circuit having an exit portion, which may be defined by a diverging exit portion, an inner air circuit having a diverging outlet configured to direct air toward the exit portion of the outer air circuit, and a fuel circuit outboard of the inner air circuit and having an exit communicating with the outer air circuit upstream from the exit portion of the outer air circuit, wherein a pre-filming surface extends downstream from the exit of the fuel circuit to a terminal lip at the outlet of the inner air circuit.

As an alternative, a radially inner wall of the inner air circuit would extend axially and radially beyond the terminal lip of the pre-filming surface to enhance the fuel-air mixing prior to combustion. As another alternative, the exit of the fuel circuit is configured to direct fuel radially outward into the outer air circuit so that the fuel will be primarily atomized by the outer airflow. In such a configuration, any residual fuel flowing along the pre-filming surface will be atomized by the inner air flowing across the terminal lip at the outlet of the inner air circuit.

In another embodiment of the subject invention, the air-blast fuel injector includes a main fuel atomization system including a main outer air swirler having an exit portion, which may include a diverging exit portion, a main inner air swirler having an outlet configured to direct air toward the exit portion of the outer air swirler, and a main fuel swirler radially outboard of the main inner air swirler, wherein the main fuel swirler has an exit in direct communication with the main outer air swirler located upstream from the outlet of the main inner air swirler. The fuel injector further includes an intermediate air swirler radially inboard of the main inner air swirler and a pilot fuel delivery system radially inboard of the intermediate air swirler.

These and other features and benefits of the air-blast fuel atomization nozzle of the subject invention and the manner in which it is assembled and employed will become more readily apparent to those having ordinary skill in the art from the following enabling description of the preferred embodiments of the subject invention taken in conjunction with the several drawings described below.

BRIEF DESCRIPTION OF THE DRAWINGS

So that those skilled in the art to which the subject invention appertains will readily understand how to make and use the fuel nozzle assembly of the subject invention without undue experimentation, preferred embodiments thereof will be described in detail hereinbelow with reference to certain figures, wherein.

DETAILED DESCRIPTION OF PREFERRED EMBODIMENTS

Figure 1:
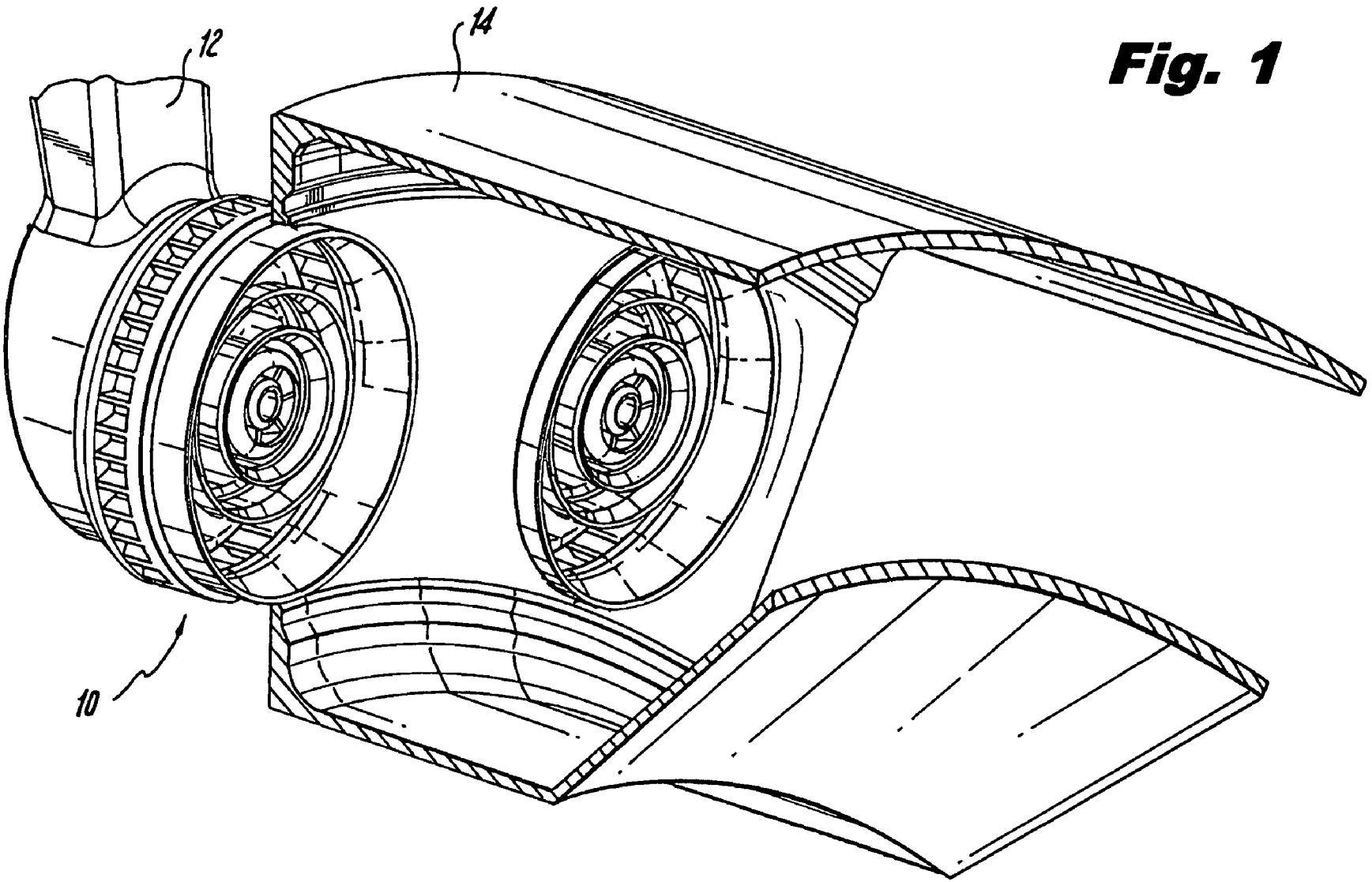
FIG. 1 is a perspective view of a nozzle body constructed in accordance with the subject invention and shown within a combustion chamber of a gas turbine engine.

Referring now to the drawings, wherein like reference numerals identify or otherwise refer to similar structural features or elements of the various embodiments of the subject invention, there is illustrated in FIG. 1 a radially outwardly flowing air-blast fuel nozzle constructed in accordance with the subject invention and designated generally by reference numeral 10. As illustrated, fuel nozzle 10 is a two-stage nozzle provided at the end of a feed arm 12 of a fuel injector, for issuing atomized fuel into the combustion chamber 14 of a gas turbine engine.

As discussed further below, fuel nozzle 10 is particularly well adapted and configured to effectuate two-stage combustion within a gas turbine engine for enhanced operability and lean combustion for low pollutant emissions. In particular, fuel nozzle 10 is configured as a multi-staged, lean direct injection (LDI) combustion system, through which 60-70% of the combustion air flows through the nozzle with the balance of the air used for combustor dome and combustion chamber wall cooling. This effectively reduces pollutant emissions such as nitrogen oxides, carbon monoxides and unburned hydrocarbons. Examples of fuel nozzles of this type are disclosed in U.S. Patent Application Publication No. 2006/0248898, the disclosure of which is incorporated herein by reference in its entirety.

Figure 2:
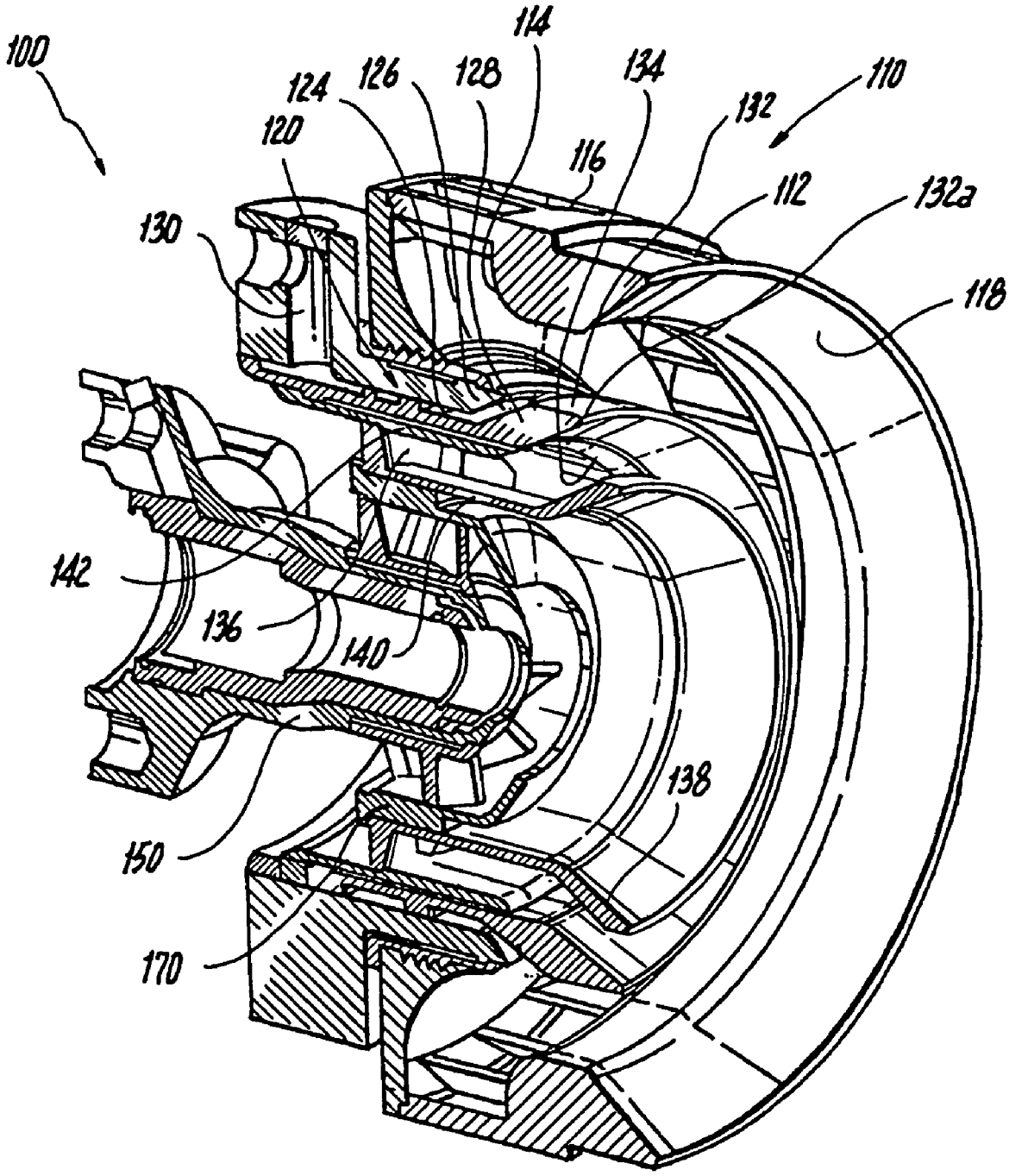
FIG. 2 is a perspective view of a nozzle body constructed in accordance with the subject invention, shown in cross-section to illustrate the component parts thereof, including, among others, a radial outer air swirler and an axial inner air swirler.
Figure 3:
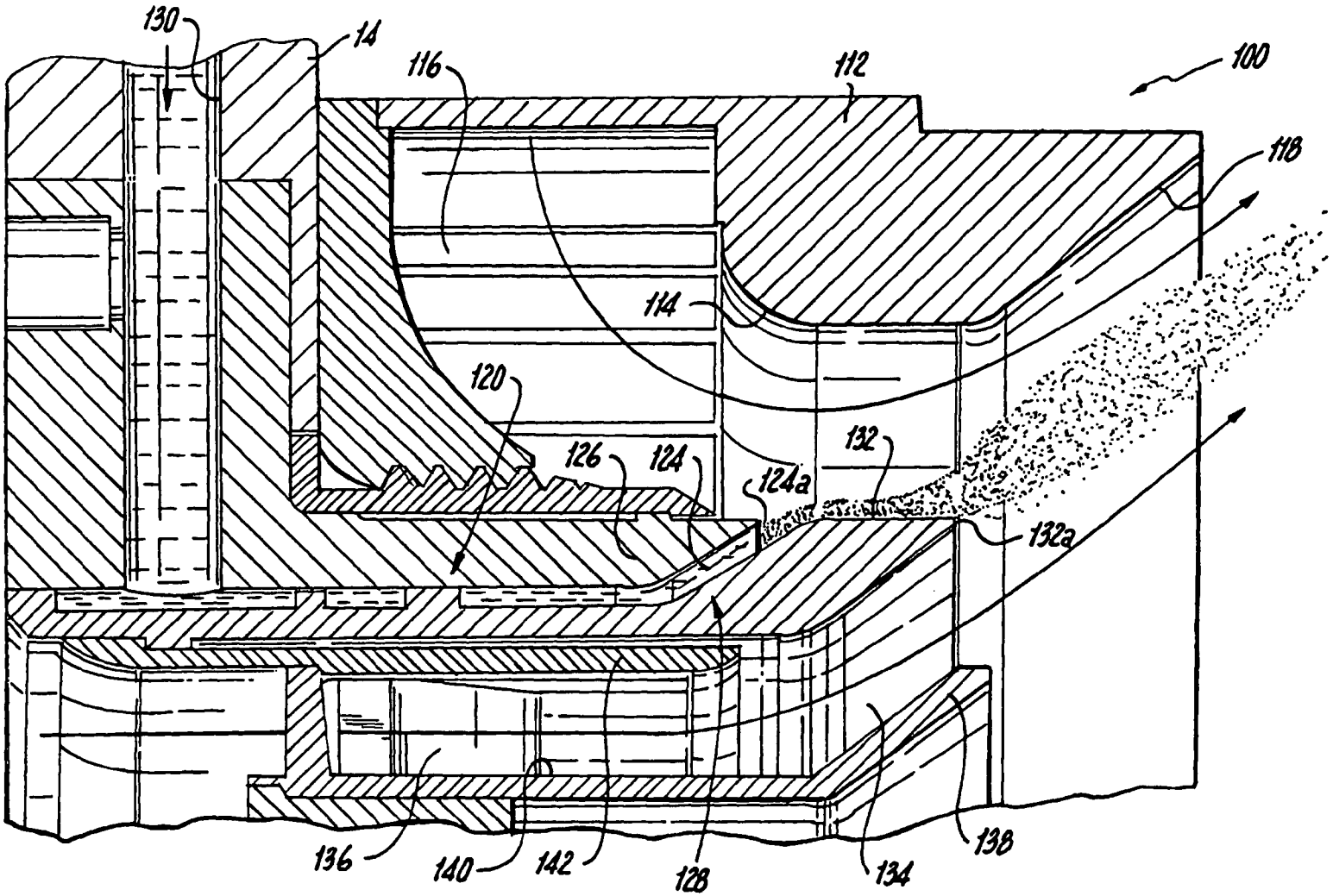
FIG. 3 is a cross-sectional view of a quadrant of the nozzle body shown in FIG. 2, wherein fuel exiting the fuel passage is shown flowing along the pre-filming surface so as to be stripped off by the inner and outer air flow.

Referring now to FIGS. 2 and 3, there is illustrated a radially outwardly flowing air-blast fuel nozzle constructed in accordance with a preferred embodiment of the subject invention and designated generally by reference numeral 100. Nozzle 100 includes an outer fuel delivery system 110 and an on-axis inner fuel delivery system 150. The outer fuel delivery system 110 serves as the main fuel delivery system of nozzle 100. The inner fuel delivery system 150 serves as the pilot fuel delivery system for nozzle 100, and is a preferably configured as pre-filming air-blast type atomizer.

Fuel nozzle 100 also includes an intermediate air swirler 170 located radially outboard of the pilot atomizer 150. This intermediate air swirler 170 is configured to provide a film of cooling air across the downstream side of the inner wall of the main fuel delivery system 110, which is exposed to hot combustion products. Fuel nozzles with intermediate air swirlers are disclosed in U.S. Patent Application Publication No. 2006/0248898.

The outer/main fuel delivery system 110 includes an outer air cap 112 defining an outer air circuit 114. The outer air circuit or outer air passage 114 has an inlet defined by an outer radial air swirler 116 and an exit portion defined by a diverging discharge bell 118. A fuel delivery circuit or fuel swirler 120 is positioned radially inboard of the outer air circuit 114. The fuel swirler 120 has a fuel swirling passage 124 defined between an outer swirler body 126 and an inner swirler body 128.

The fuel swirling passage 124 receives fuel from a fuel feed passage 130 communicating with the injector feed arm 12. The inner swirler body 128 includes a pre-filming surface 132 that extends from the outlet portion 124*a* of the fuel swirling passage 124 to a terminal lip 132*a*, as best seen in FIG. 3. It is envisioned that the outlet portion 124*a*, also referred to as the fuel spin chamber, could be configured to form either a continuous sheet of fluid or a series of discrete fluid jets, as is known in the art.

In this regard, the number of discrete fluid jets would correspond to the number of circumferentially disposed fuel swirl slots formed in the fuel swirler. Small slot angles of 0° to 30° relative to the axis of the spin chamber would generally result in discrete jets issuing from the fuel passage, whereas large slot angles of 60° and higher relative to the axis of the spin chamber would generally result in a single sheet of fuel issuing from the fuel swirl passage. Fuel swirl slot angles falling in the intermediate range (e.g., 30°-60°) could potentially produce a continuous sheet, discrete jets, or some other form or morphology, which is in-between the two, such as a lobed-sheet. Those skilled in the art will readily appreciate that the ability to produce different types of fuel sprays permits greater control over fuel placement (e.g., deeper penetration of the fuel into the outer-air stream).

The outer/main fuel delivery system 110 of fuel nozzle 100 further includes an inner air circuit 134. The inner air circuit 134 has an upstream inlet defined at least in part by an inner axial air swirler 136 and an exit defined by a diverging inner air cap 138. An inboard wall 140 and an outboard heat shield 142 form the inner air circuit or inner air passage 134. Heat shield 142 protects the fuel circuit from the high temperature combustion air flowing through the inner air circuit 134.

In operation, as best seen in FIG. 3, fuel exits from the spin chamber of the fuel swirling passage 124 and flows along the pre-filming surface 132. As the fuel flows toward the terminal lip 132*a* of the pre-filming surface 132 it is stripped away by the air flowing through the outer air circuit or passage 114.

In addition, the air flowing through the inner air circuit or passage 134 strips off fuel that arrives at the terminal lip 132*a* of pre-filing surface 132. That is, the diverging inner wall of 138 of the inner air passage 134 is contoured to direct the airflow from the inner air swirler 136 across the downstream lip 132*a* of the pre-filming surface 132 in order to direct the air kinetic energy to the liquid film issuing from the end of the pre-filmer to effect atomization and enhanced fuel/air mixing.

Thus, fuel issuing from the fuel swirler 120 does not flow radially inward, as in prior art air-blast atomizers, but rather the fuel issuing from the fuel swirler 120 flows radially outward and exits the fuel swirler at a diameter that is greater than the diameter of the fuel swirl passage 124. The co-flowing inner and outer air is then used to effect atomization and mixing of the fuel and air.

As shown in this embodiment of the subject invention, the inner air swirler of the radially outwardly flowing air-blast fuel nozzle 100 is an axial air swirler 134 and the outer swirler 116 is a radial air swirler. However, it is envisioned and well within the scope of the subject invention that the outer and inner air swirlers 116, 136 of fuel nozzle 100 could be configured as either axial or radial type-swirlers; clock-wise or counter-clockwise in swirl direction; and either co-swirling or counter-swirling with respect to each other and/or with respect to swirl-direction of the fuel flowing through the fuel swirler 120. Those skilled in the art will readily appreciate that such design alternatives can be employed in whole or in part in each of the radially outward flowing air-blast fuel nozzles described below.

Figure 4:
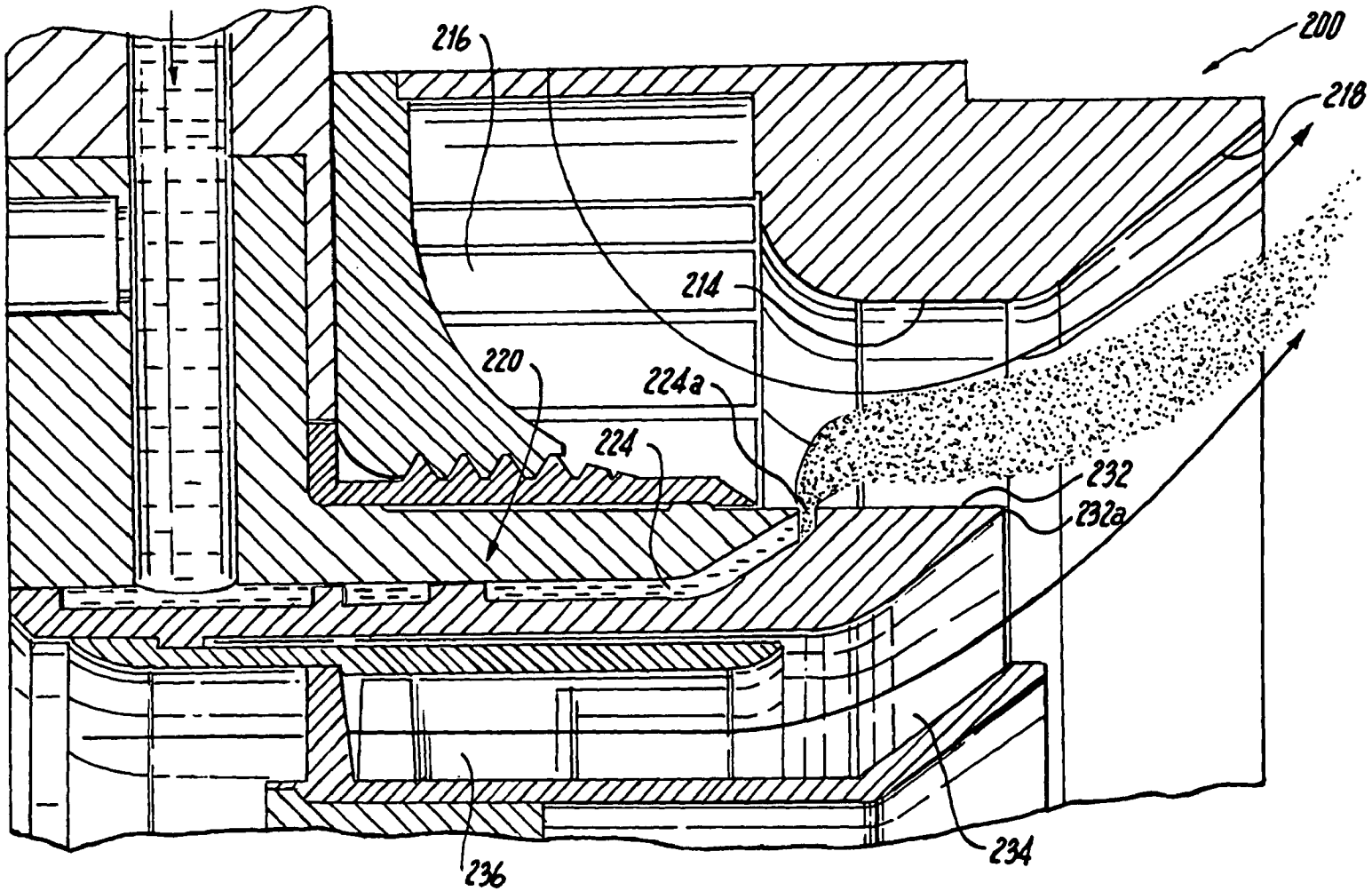
FIG. 4 is a cross-sectional view of a quadrant of another nozzle body constructed in accordance with the subject invention, similar to the embodiment shown in FIGS. 2 and 3, wherein the exit of the fuel passage is contoured so that fuel exits radially outward into the outer air stream where it is primarily atomized by the outer air flow, and wherein residual fuel flowing along the pre-filming surface is atomized by the inner air flow.

Referring to FIG. 4, there is shown another radially outward flowing air-blast fuel nozzle constructed in accordance with the subject invention, which is similar to the embodiment shown in FIGS. 2 and 3, and is designated generally by reference numeral 200. Fuel nozzle 200 includes an outer air passage 214 having an inlet defined by an outer radial air swirler 216 and an exit portion defined by a diverging discharge bell 218, a fuel delivery circuit 220 having a fuel swirling passage 224 and an inner air passage 234 having an axial inner air swirler 236.

In fuel nozzle 200, the exit 224*a* of the fuel swirling passage 224 of the fuel circuit 220 is contoured in such a manner so that fuel exits radially outward into the outer air stream flowing through the outer air passage 214. More particularly, the fuel exits the fuel spin chamber at an angle that is substantially orthogonal to the pre-filming surface 232. In this case, residual fuel that is not carried away by the primary atomizing outer air stream, but which instead flows along the pre-filming surface 232, is stripped off by the terminal lip 232*a* by the air stream flowing from the inner air passage 234.

In this embodiment, the exit of the spin-chamber of fuel delivery circuit 220 is configured to force the liquid fuel radially outward into the cross-flowing outer air path. Moreover, the exit of the spin-chamber is contoured to have a radially outward flow-path with sharp edges at the exit plane. It is envisioned that the exiting fuel from the fuel delivery passage could form either a continuous sheet or a series of discrete jets depending upon the angle of the fuel spin slots of the fuel swirler relative to the axis of the swirler.

Figure 5:
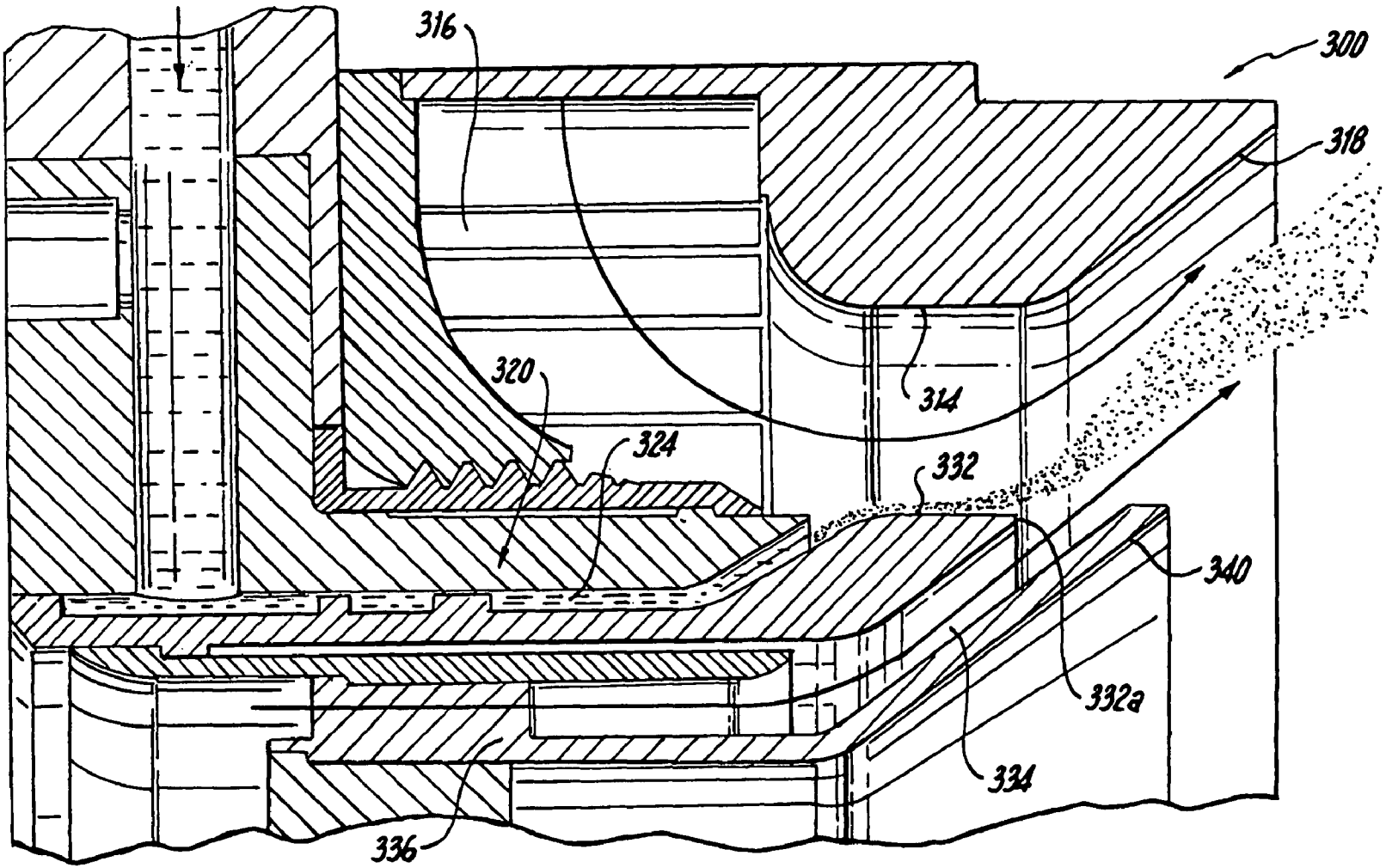
FIG. 5 is a cross-sectional view of a quadrant of yet another nozzle body constructed in accordance with the subject invention, similar to the embodiment shown in FIGS. 2 and 3, wherein the radially inner wall of the inner air passage extends axially and radially beyond the exit lip of the pre-filming surface to enhance mixing of the fuel and air.

Referring to FIG. 5, there is shown yet another radially outward flowing air-blast fuel nozzle constructed in accordance with the subject invention, which is similar to the embodiment shown in FIGS. 2 and 3, and is designated generally by reference numeral 300. Fuel nozzle 300 includes an outer air passage 314 having an inlet region defined by an outer radial air swirler 316 and an exit portion defined by a diverging discharge bell 318, a fuel delivery circuit 320 having a fuel swirling passage 324 and an inner air circuit 334. The inner air circuit 334 of fuel nozzle 300 differs from that of fuel nozzle 200 in that the inner axial air swirler 336 is defined by straight stand-offs as opposed to curved vanes. Those skilled in the art will readily appreciate that these two structures are interchangeable.

In fuel nozzle 300, the inboard wall 340 of the inner air circuit 334 extends axially and radially beyond the exit lip 332*a* of the pre-filming surface 332 to enhance mixing of the fuel with the air streams flowing through the inner and outer air circuits 314 and 334. The extension of the inboard wall 340 permits an increased residence time for the fuel and air to mix prior to combustion. The improved mixing leads to reduced levels of emissions under lean fuel conditions.

Figure 6:
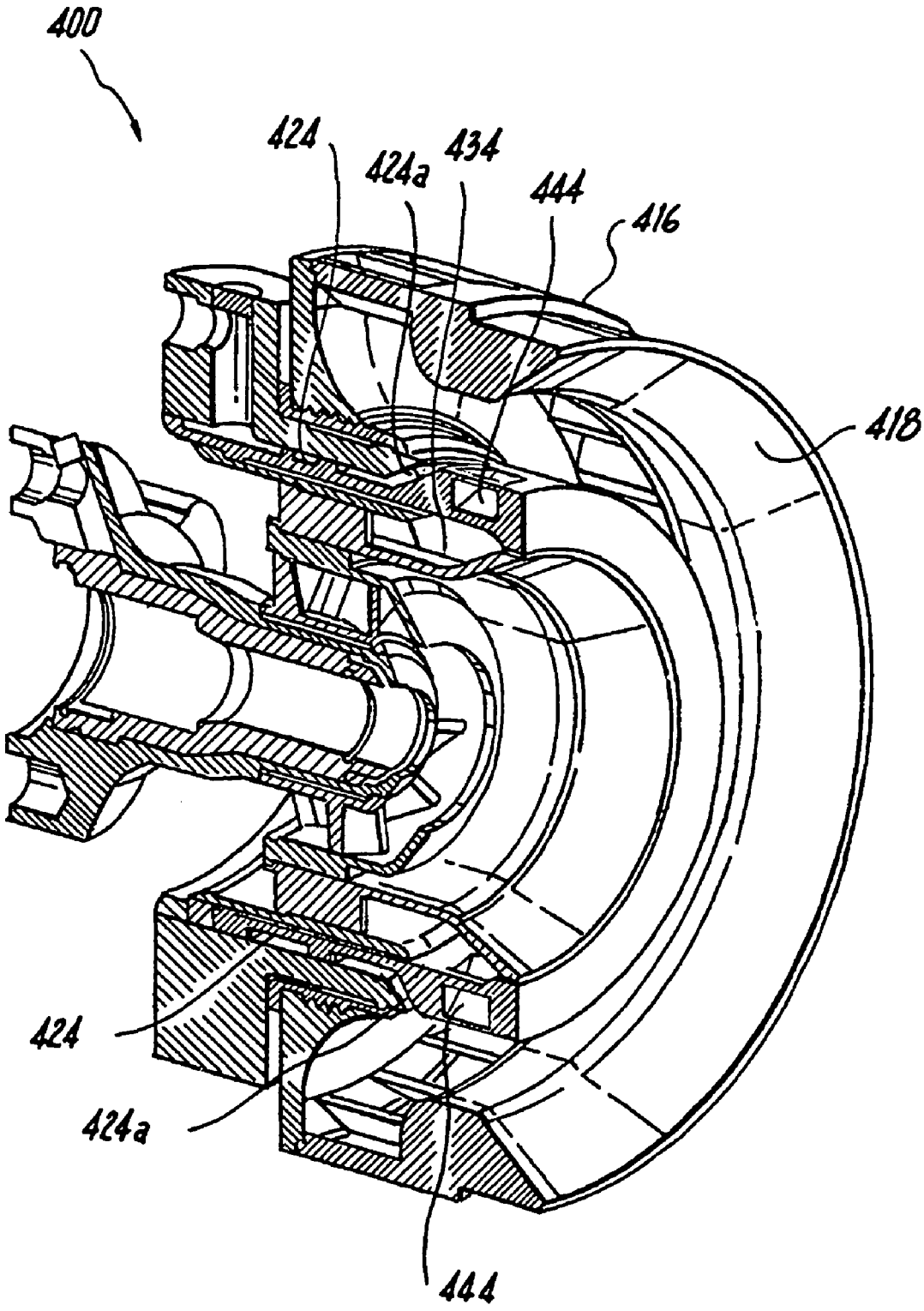
FIG. 6 is a perspective view of another nozzle body constructed in accordance with the subject invention, shown in cross-section to illustrate the component parts thereof, including, among others, a radial outer air swirler and a radial inner air swirler.
Figure 7:
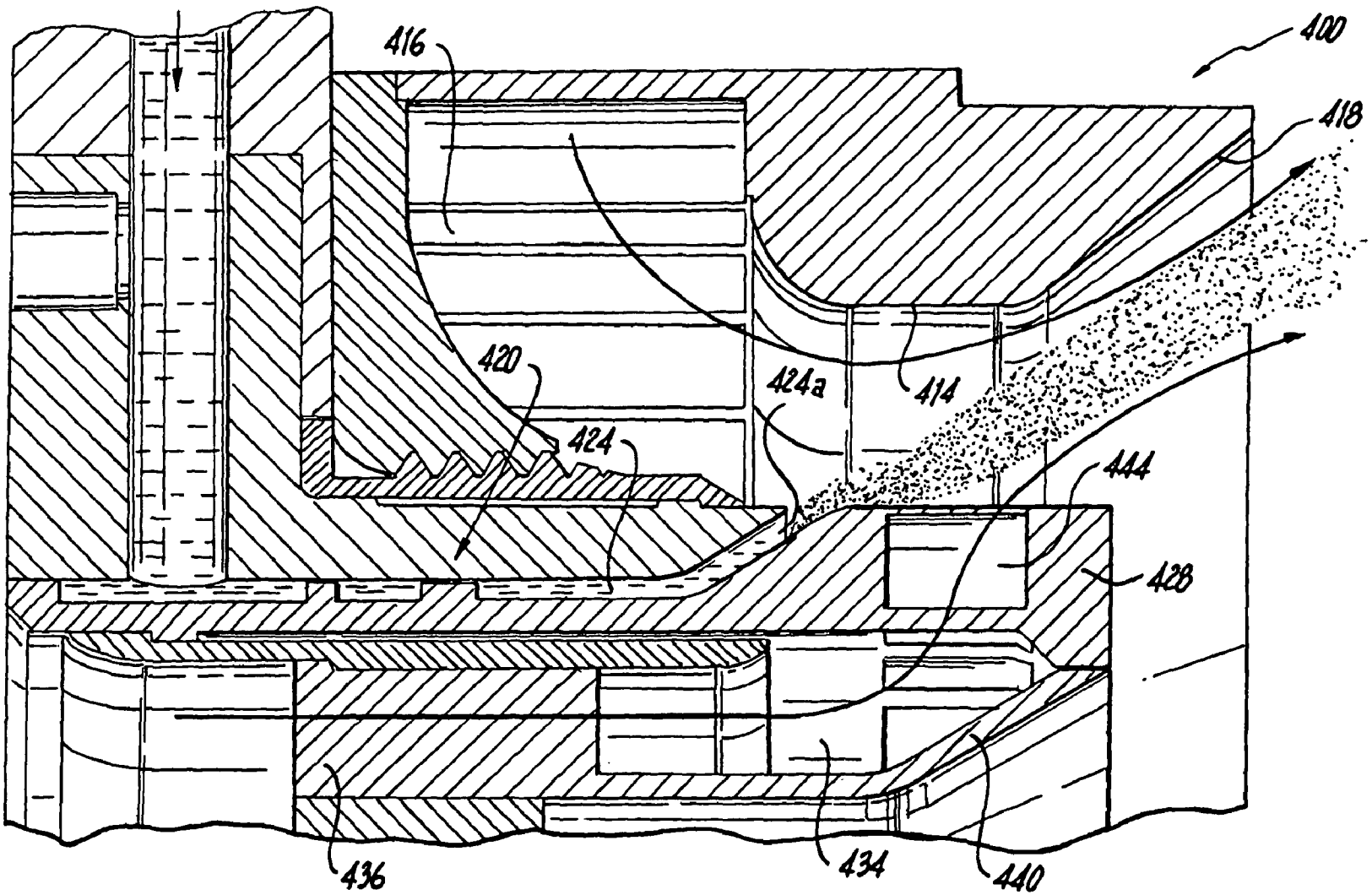
FIG. 7 is a cross-sectional view of a quadrant of the nozzle body shown in FIG. 6, wherein the radial inner air swirler discharges air downstream from the fuel exit.

Referring to FIGS. 6 and 7, there is illustrated another radially outward flowing air-blast fuel nozzle constructed in accordance with a preferred embodiment of the subject invention and designated generally by reference numeral 400. Fuel nozzle 400 includes an outer air passage 414 having an inlet portion defined by an outer radial air swirler 416 and an exit region including a diverging discharge bell 418, a fuel delivery circuit 420, having a fuel swirling passage 424 and an inner air passage 434 having axially straightened stand-offs 436.

In fuel nozzle 400, the outlet of the inner air passage 434 is defined by an inner radial air swirler 444, which directs the inner air stream into the outer air circuit 414. More particularly, as shown in FIG. 7, the inner radial air swirler 444 discharges air downstream from the exit 424*a* of the fuel swirl passage 424 of the fuel delivery circuit 420. This is designed to enhance the fuel/air mixing by forcing the fuel from the atomizer to penetrate further outward (radially) into the outer-air stream, and thereby increase the turbulent mixing just downstream of the fuel exit. This enhances atomization.

In this configuration of the fuel injector, the diverging inboard wall 440 of the inner air passage 434 abuts the radially inner surface of the inner swirler body 428 to provide a diverging axial terminus for the inner air passage 434, which directs the inner air stream in a radially outward direction toward the discharge ports of the inner radial air swirler 444, as best seen in FIG. 7.

Another advantage to this embodiment is the creation of a base-region for improved separation between the pilot combustion zone and the main combustion zone, for the case where the invention is applied to the main fuel delivery of a two-circuit fuel atomizer. The downstream end of the radial inner air swirler forms the base region. It is envisioned and well within the scope of this invention that additional air-cooling holes may be added to this base region in order to improve thermal management.

Figure 8:
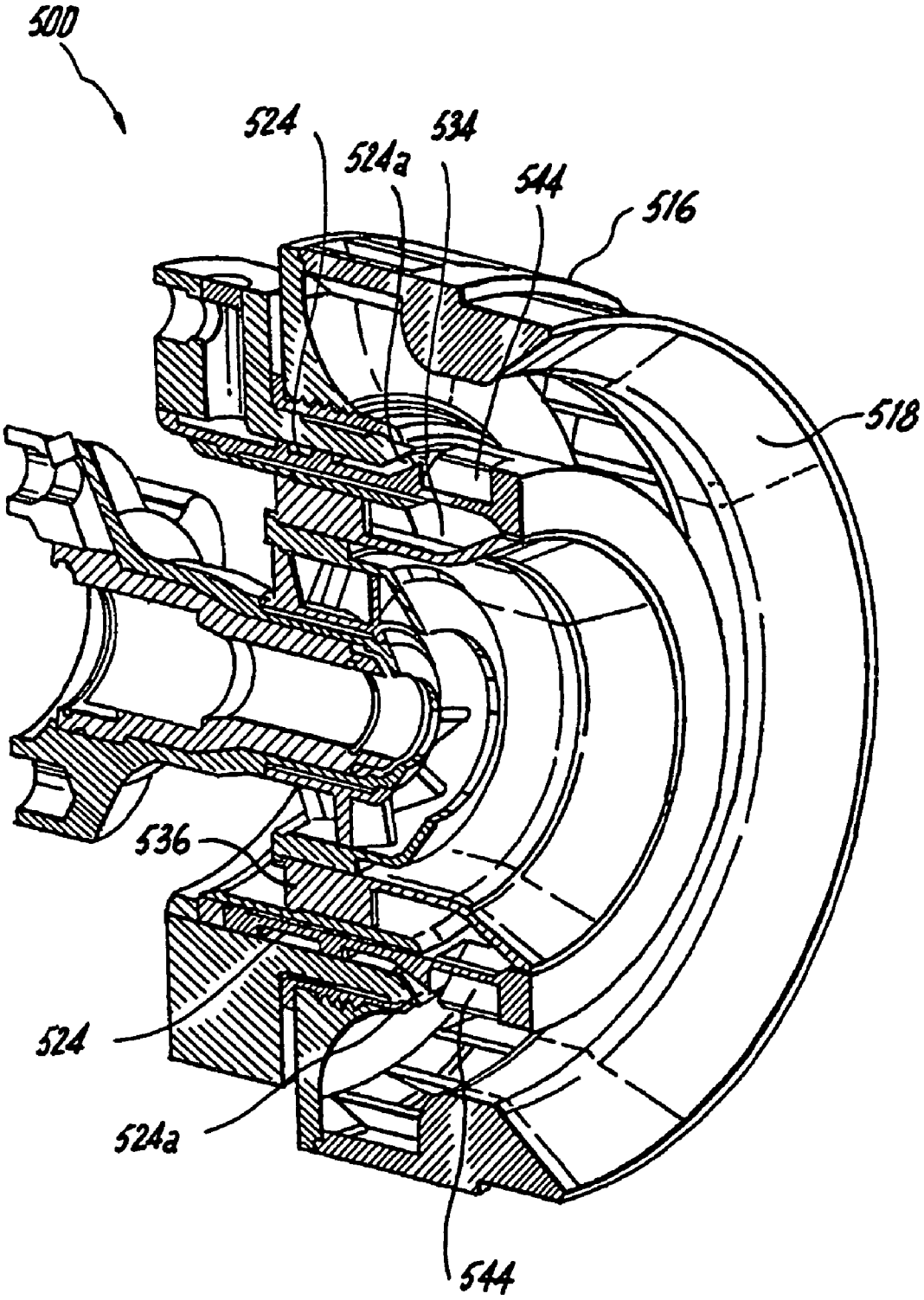
FIG. 8 is a perspective view of another nozzle body constructed in accordance with the subject invention, shown in cross-section to illustrate the component parts thereof, including, among others, a radial outer air swirler and a radial inner air swirler.
Figure 9:
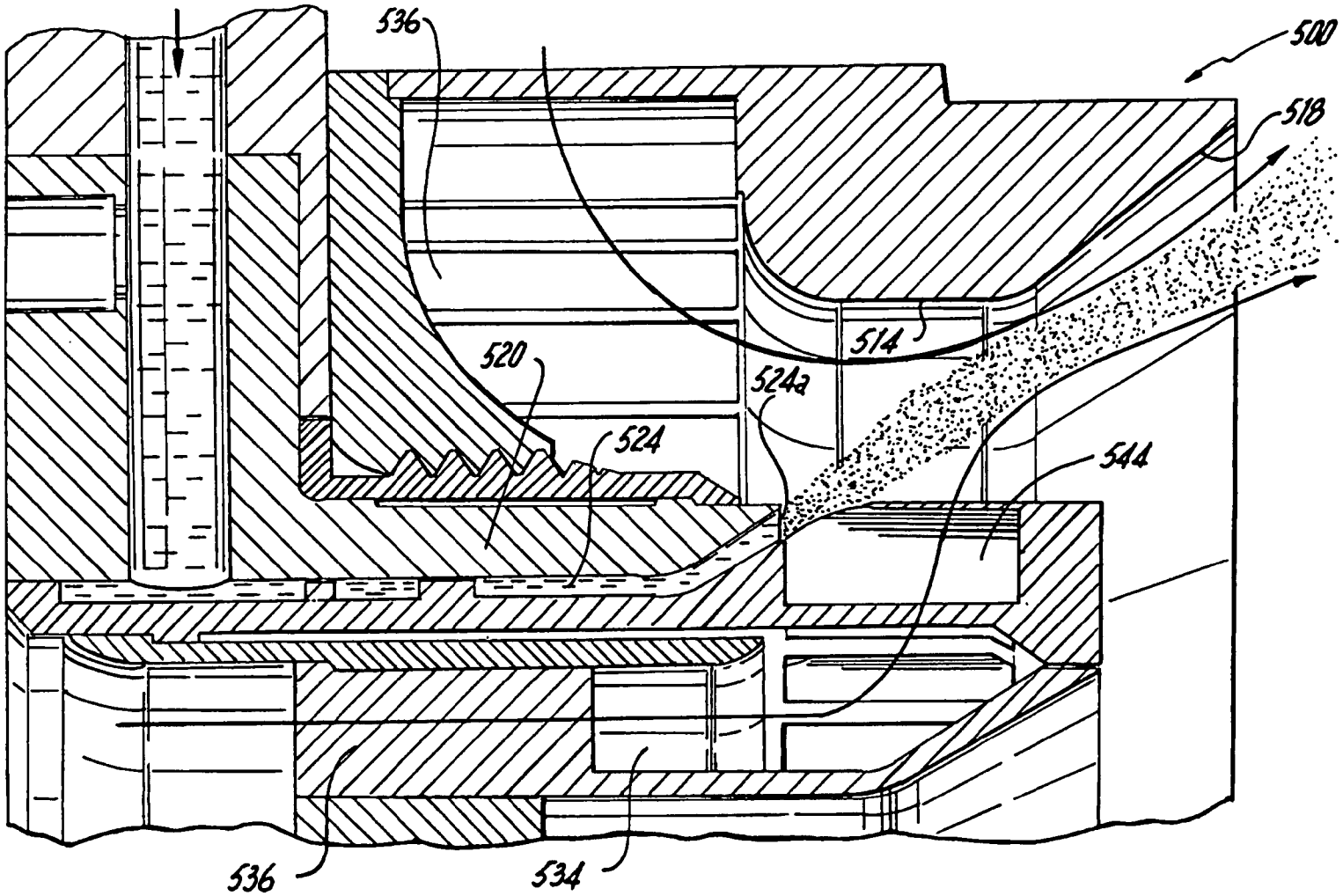
FIG. 9 is a cross-sectional view of a quadrant of the nozzle body shown in FIG. 8, wherein the radial inner air swirler is partially embedded in the exit of the fuel passage to enhance atomization and mixing of the fuel and air.

Referring to FIGS. 8 and 9, there is illustrated yet another radially outward flowing air-blast fuel nozzle constructed in accordance with a preferred embodiment of the subject invention and designated generally by reference numeral 500. Fuel nozzle 500 includes an outer air passage 514 having an inlet portion defined by an outer radial air swirler 516 and an exit portion including a diverging discharge bell 518, a fuel delivery circuit 520 having a fuel swirling passage 524 and an inner air passage 534 having inner axially straightened standoffs 536.

In fuel nozzle 500, the radial inner air swirler 544 is partially embedded in the exit 524*a* of the fuel swirl passage 524, as best seen in FIG. 9. That is, the inner radial air swirler 544 is axially extended in the upstream direction, as compared to FIG. 7, so that it cuts into the inner wall of the fuel passage 524. This variation yields even closer contact between the fuel and the air for enhanced atomization and mixing, resulting in reduced levels of emissions under lean fuel conditions.

Although the radially outward flowing air-blast fuel nozzle of the subject invention is described as shown as a main fuel atomizer for a multiple fuel circuit nozzle (e.g. pilot and main fuel atomizers), it is envisioned that the radially outward filming air-blast fuel nozzle could be a solitary fuel atomizer on a single fuel circuit nozzle. Alternatively, the nozzle could be a multiple fuel circuit nozzle wherein the main/outer fuel atomizer is a radially outward flowing air-blast fuel atomizer and the pilot/inner fuel atomizer is a radially outward flowing air-blast fuel atomizer.

Thus, while the fuel nozzle of the subject invention has been described with respect to preferred embodiments, those skilled in the art will readily appreciate that changes and modifications may be made thereto without departing from the spirit and scope of the subject invention as defined by the appended claims.

What is claimed is:

1. An air-blast fuel injector comprising:

a) an outer air circuit having an exit portion;

b) an inner air circuit having an outlet configured to direct air toward the exit portion of the outer air circuit;

c) a fuel circuit radially outboard of the inner air circuit and having an exit located in the outer air circuit upstream from the exit portion of the outer air circuit;

d) an intermediate air swirler radially inboard of the inner air circuit; and e) a pilot fuel delivery system radially inboard of the intermediate air swirler.

2. An air-blast fuel injector as recited in claim 1, wherein a pre-filming surface extends downstream from the exit of the fuel circuit to a terminal lip at the outlet of the inner air circuit.

3. An air-blast fuel injector as recited in claim 1, wherein the exit portion of the outer air circuit is a diverging exit portion.

4. An air-blast fuel injector comprising:

a) an outer air circuit having an exit portion;

b) an inner air circuit having a diverging outlet configured to direct air toward the exit portion of the outer air circuit;

c) a fuel circuit radially outboard of the inner air circuit and having an exit located in the outer air circuit upstream from the exit portion of the outer air circuit, wherein a pre-filming surface extends downstream from the exit of the fuel circuit to a terminal lip at the outlet of the inner air circuit;

d) an intermediate air swirler radially inboard of the inner air circuit; and e) a pilot fuel delivery system radially inboard of the intermediate air swirler.

5. An air-blast fuel injector as recited in claim 4, wherein the exit portion of the outer air circuit is a diverging exit portion.

6. An air-blast fuel injector for a gas turbine engine comprising:

a) a main fuel atomization system including a main outer air swirler having an exit portion, a main inner air swirler having an outlet configured to direct air toward the exit portion of the outer air swirler, and a main fuel swirler radially outboard of the main inner air swirler, wherein the main fuel swirler has an exit located in the main outer air swirler located upstream from the outlet of the main inner air swirler;

b) an intermediate air swirler radially inboard of the main inner air swirler; and c) a pilot fuel delivery system radially inboard of the intermediate air swirler.

7. An air-blast fuel injector as recited in claim 6, wherein a pre-filming surface extends downstream from the exit of the main fuel swirler to a terminal lip at the outlet of the main inner air swirler.

8. An air-blast fuel injector as recited in claim 6, wherein the exit portion of the outer air circuit is a diverging exit portion.

* * * * *